United States Patent [19]

DeMuth

[11] 4,197,689

[45] Apr. 15, 1980

[54] BULK STORAGE VESSELS

[75] Inventor: Harry C. DeMuth, Chicago, Ill.

[73] Assignee: DeMuth Steel Products Company, Schiller Park, Ill.

[21] Appl. No.: 869,163

[22] Filed: Jan. 13, 1978

[51] Int. Cl.[2] ..... B21D 39/03; E04G 21/14

[52] U.S. Cl. ..... 52/745; 52/122; 52/245; 52/747

[58] Field of Search ..... 220/75, 79, 1 B, 5 A; 29/428, 429; 52/192–197, 528, 245, 247, 542, 588, 745, 747, 122, 123

[56] References Cited

U.S. PATENT DOCUMENTS

| | | | |
|---|---|---|---|
| 475,656 | 5/1892 | Bertels | 220/79 |
| 1,076,382 | 10/1913 | Maloney | 220/5 A |
| 1,125,070 | 1/1915 | Daviee | 220/5 A |
| 1,429,400 | 9/1922 | Bloedow | 52/588 |
| 1,706,924 | 3/1929 | Kane | 52/542 |
| 3,092,216 | 6/1963 | Tye | 52/745 |
| 3,381,432 | 5/1968 | Brandwein | 52/86 |
| 3,902,288 | 9/1975 | Knudson | 52/86 |

FOREIGN PATENT DOCUMENTS

| | | | |
|---|---|---|---|
| 553406 | 2/1958 | Canada | 52/122 |
| 668682 | 11/1929 | France | 52/245 |
| 416197 | 1/1967 | Switzerland | 52/192 |

*Primary Examiner*—John E. Murtagh
*Attorney, Agent, or Firm*—Mason, Kolehmainen, Rathburn & Wyss

[57] ABSTRACT

A bulk storage vessel of generally cylindrical upstanding shape is formed with a plurality of wall segments which are assembled together in end to end relation to form subassemblies of circular shape. These subassemblies are then flange interconnected along upper and lower edges to provide a cylindrical vessel. Each of the wall segments includes a curved side wall of generally rectangular shape having roll formed flange structures along both its upper and lower edges and a vertical end flange at one end. The upper edge flange structures include an outwardly extending horizontal flange section and a downturned vertical flange section integrally rolled therewith. Along the lower edge, the flange structure includes an outwardly extending horizontal flange section, a downturned vertical flange section and an inwardly extending flange section joined to the lower edge of the downturned vertical flange and deflectable for interlocking engagement with the upper edge flange structure of an adjacent lower subassembly.

A first subassembly of wall segments connected end to end into a circular cylindrical segment is formed at ground level and is then elevated to a height sufficient to clear the wall segments of a second subassembly which are positioned therebelow during assembly. These wall segments of the second subassembly are interconnected with the lower flange structure of the upwardly spaced first subassembly and the wall segments are supported by this flanged interconnection while the lower or second wall segments are being connected end to end. The interconnected flanges of the two subassemblies are crimped together externally of the vessel.

4 Claims, 5 Drawing Figures

FIG. 1
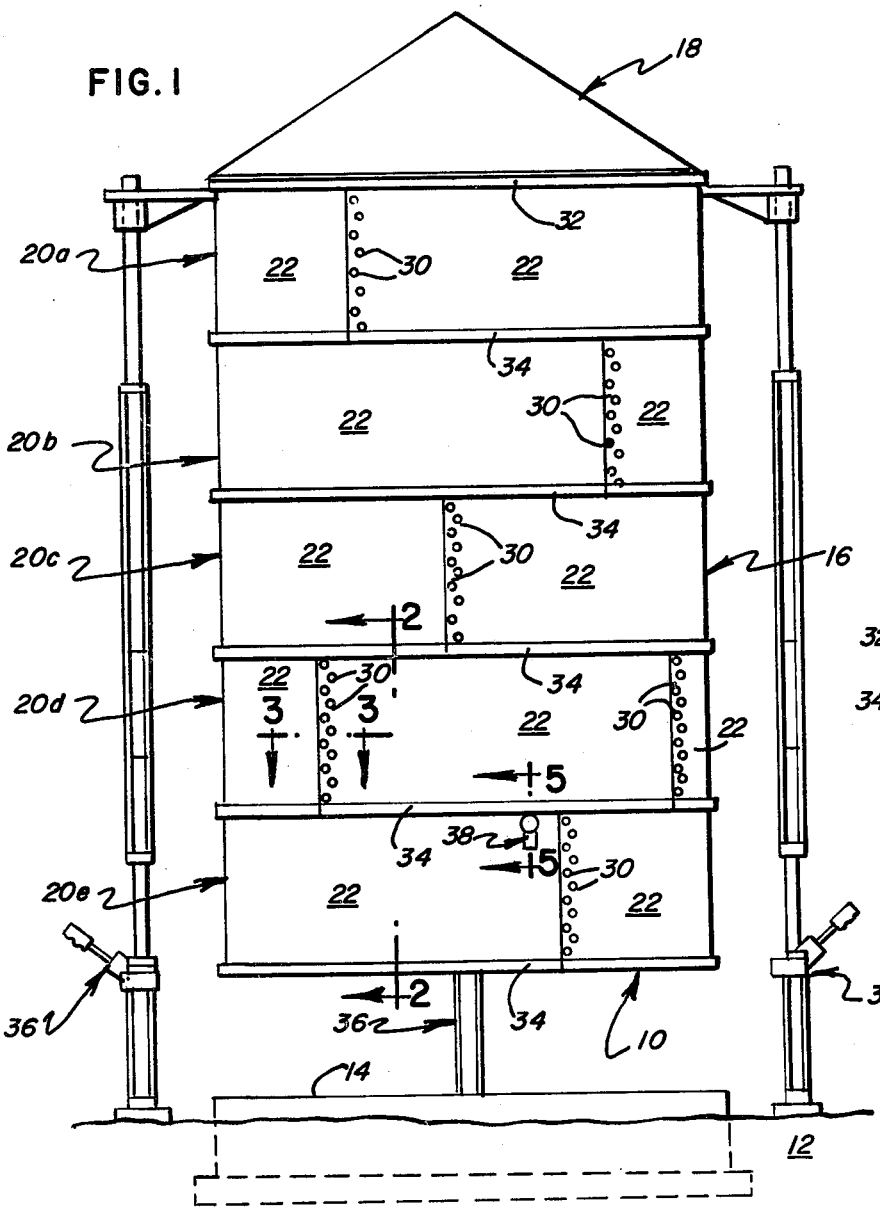
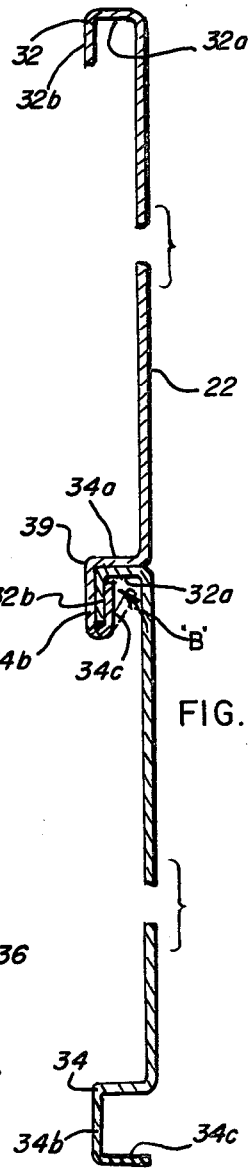
FIG. 2
FIG. 5
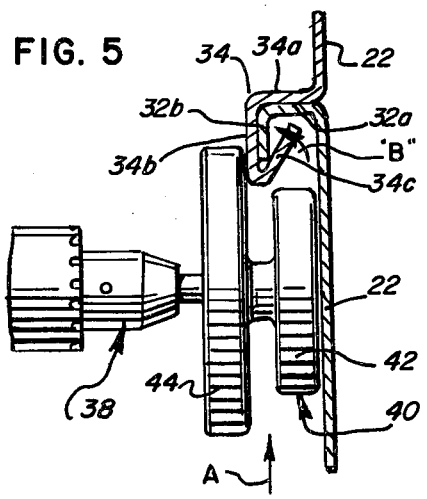
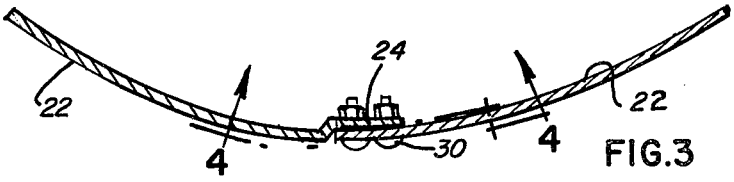
FIG.3
FIG.4
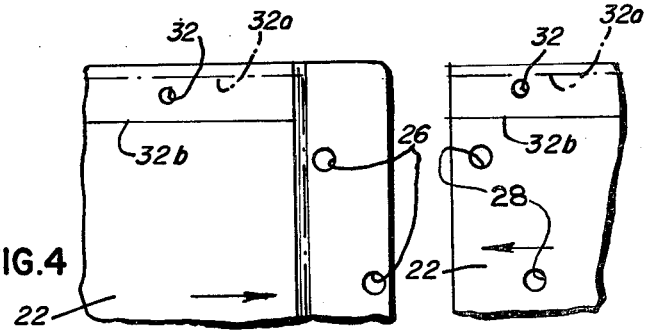

BULK STORAGE VESSELS

BACKGROUND OF THE INVENTION

1. Field of the Invention

The present invention relates to a new and improved method and apparatus for making cylindrical storage vessels more particularly vessels of the type that are suitable for storing agricultural and other bulk materials. The present invention relates both to a new and improved, economical bulk produce storage vessel of the character described and also is directed to a new and improved method of making and constructing a storage vessel on site in a manner which reduces costs and also reduces the time required for the erection and completion of a vessel of a given storage capacity.

2. Description of the Prior Art

A wide variety of storage vessels, grain bins, tanks and the like have been provided for storing bulk materials such as agricultural products, chemicals and other bulk mineral products and the like.

It is an object of storage enclosures to generally provide a maximum volume of storage capacity at a minimum cost commensurate with adequate protection and sealing of the stored materials to protect from damage by external conditions or the atmosphere. In U.S. Pat. No. 3,838,498, there is illustrated a system for making storage vessels from continuous sheet metal strip which is wound in a spiral with the joints between adjacent edges of adjacent helical turns in the spiral being roll formed to provide wall sealing as well as structural interconnection between the spiral turns both during and after the erection process is completed. Other generally cylindrical storage vessels have been formed of hot rolled and corrugated plate or sheet materials in segments which are welded or otherwise attached together to form the wall structure of a storage vessel.

The present invention is directed towards a new and improved method and apparatus for producing bulk storage vessels of the character described.

More particularly, it is an object to provide a new and improved bulk storage vessel with sheet metal wall segments having roll formed upper and lower edge flange structures which are interconnected in a novel manner requiring a minimum amount of labor and material.

The present invention also has an object to provide a storage vessel which has good weather seal characteristics as well as a vessel which is economical in terms of material required and overall labor required per unit volume of storage capacity provided.

It is therefor an object of the invention to provide a new and improved storage vessel for bulk materials and the like which utilizes a new and improved method for erecting and constructing the vessel in an advantageous manner.

Still another object of the invention is to provide a new and improved storage vessel which employs a plurality of arcuately curved wall segments of formed sheet metal with roll formed flange structures along upper and lower edges, which flanges are adapted to be easily interconnected with adjoining flange structures of other wall segments without requiring the use of rivets, bolts and other types of conventional fasteners.

SUMMARY OF THE INVENTION

The foregoing and other objects and advantages of the present invention reside in a new and improved, upstanding bulk storage vessel of generally cylindrical shape for use in storing agricultural or other bulk products. The storage vessel is formed with a plurality of specially designed sheet metal wall segments which are assembled together in end to end relation to form circular subassemblies. These subassemblies are flangedly interconnected along upper and lower edges to provide a cylindrical vessel of any desired height, which height depends upon the number of subassemblies that are interconnected together.

Each of the wall segments includes a curved, sheet metal, side wall of generally rectangular shape having a pair of roll formed flange structures along both its upper and lower edges and an inset vertical end flange at one end. The upper edge flange structure includes an outwardly extending horizontal flange section and a downturned depending vertical flange section integrally rolled therewith. Along the lower edge, the flange structure includes an outwardly extending horizontal flange section, a downturned depending vertical flange section and an inwardly extending deflectable flange section joined with the lower edge of the downturned vertical flange and adapted to be deflected into close interlocking engagement with the upper edge flange structure of an adjacent lower subassembly. In erecting a storage vessel, a first subassembly of wall segments is assembled by connecting wall segments end to end to form a circle. The subassembly is then elevated to a height sufficient to clear a next group of wall segments used to form a second subassembly. Individually, the next group of wall segments are interconnected with the lower flange structure of the upwardly spaced, completed first subassembly and the lower wall segments are supported in hanging relation by the flanged interconnection while the hanging segments are connected together in end to end relation. After completion of the second subassembly, the interconnected flanges of the two subassemblies are crimped together externally of the storage vessel wall. This provides a positive interlock between the wall segments of the respective upper and lower subassemblies of the wall segments. As many subassemblies as may be required for a particular height of structure may be interconnected together and the thickness of the sheet metal of the lower subassemblies may be increased as required to carry the increased load.

BRIEF DESCRIPTION OF THE DRAWINGS

For a better understanding of the invention, reference should be had to the following detailed description taken in conjunction with the drawings, in which:

FIG. 1 is a side elevational view of a bulk storage vessel constructed in accordance with the features of the present invention;

FIG. 2 is an enlarged, fragmentary, vertical sectional view taken substantially along lines 2—2 of FIG. 1;

FIG. 3 is an enlarged, fragmentary, horizontal sectional view taken substantially along horizontal sectional lines 3—3;

FIG. 4 is an enlarged, side elevational view looking in the direction of arrows 4—4 of FIG. 3 and illustrating the inset end flange of a wall segment before it is connected to the adjacent opposite end of an adjacent wall segment; and FIG. 5 is a fragmentary vertical sectional view taken substantially along lines 5—5 of FIG. 1 and illustrating in somewhat animated form, the externally applied rolling die wheels used for deflecting the flange segment for interconnecting the flanges of adjacent upper and lower subassemblies of the wall segments of the storage vessel wall.

DESCRIPTION OF THE PREFERRED EMBODIMENT

Referring now more particularly to the drawings, therein is illustrated a new and improved, upstanding and generally cylindrical storage vessel constructed in accordance with the features of the present invention and referred to generally by the reference numeral 10. The vessel 10 is designed to stand upright above the ground or other base level 12 on a suitable circular foundation or base 14 preferably formed of concrete or other material at the selected erection site. The storage vessel includes a generally cylindrical body or shell referred to as a whole by the reference numeral 16 and the body or shell is covered or closed at the upper end with a conical roof structure 18 of conventional design. The cylindrical shell is formed by a plurality of flangedly interconnected, cylindrical subassemblies 20*a*, 20*b*, 20*c*, etc. which subassemblies are positively interconnected around the circumference between adjacent upper and lower edges to provide a weather tight storage vessel wall. The total number of subassemblies 20*a*, 20*b*, 20*c*, etc. is determined by the maximum height or storage capacity that is required.

Each of the subassemblies is identical to the other and is formed from a plurality of arcuately rolled wall segments 22 formed of a generally rectangular shaped piece of sheet metal of the appropriate gauge or thickness. Three or more of these wall segments are interconnected at opposite ends to form one of the circular subassemblies. As illustrated best in FIGS. 3 and 4, at one end, the wall segments are formed with an inset flange 24 having a plurality of staggered, drilled openings or punched holes 26 adapted to align with punched holes or openings 28 provided in the adjacent, opposite end portion of the next adjacent wall segment. Rivets or other fasteners such as bolt and nut assemblies 30 are utilized for interconnecting the adjacent ends of the wall segments in each subassembly.

In accordance with the present invention, each wall segment is formed with a rolled flange structure 32 along its upper edge including radially outwardly extending horizontal flange section 32*a* and a downturned, depending, vertical flange section 32*b* at right angles as best shown in FIG. 2. In addition, each of the wall segments 22 includes a rolled, lower edge flange structure 34 comprising an outwardly extending, horizontal, radial flange section 34*a*, a downturned vertical flange section 34*b* integrally joined to the outer edge of the horizontal flange section and an inwardly extending, deflectable flange section 34*c* integrally joined with the lower edge of the outer vertical flange 34*b*. As illustrated in FIGS. 2 and 5, when the flange structures 32 and 34 of the respective wall segments 22 of the adjacent upper and lower subassemblies (for example 20*a* and 20*b*) are interconnected as illustrated, the flanged interconnection provides positive hanging support for the lower wall segments which are interlocked with their upper vertical flanges 32*b* extending downwardly between the lower flanges 34*b* and 34*c* of the upper supporting wall segments.

In constructing the storage vessels 10 in accordance with the novel method of the present invention, a first or uppermost subassembly 20*a* of the wall segments 22 are assembled together in end to end relationship while they are at ground level or resting on the foundation 14. After the bolts or fasteners 30 are inserted and tightened the cylindrical subassembly 20*a* is connected with the conical roof 18. Three or more supports such as jack assemblies 36 are positioned at equilaterally spaced points around the circumference of the roof and these jacks may include arms which are engaged with the upper flange structure 32 of the subassembly 20*a* for lifting or elevating the subassembly and the roof 18. The jacks are operated to lift the structure until the lower edge flange 34 of the wall segments is spaced above the upper level of the foundation or ground by a distance greater than the vertical height of the wall segments so new wall segments may be positioned below and supported with their upper flange structure 32 interlocked and hanging from the lower flange structure 34 of the subassembly 20*a* as illustrated in FIGS. 2 and 5. The individual wall segments of the next lower subassembly 20*b* are hung onto the upper subassembly 20*a* one at a time and are supported in hanging interlocked position until the inset end flanges 24 are bolted or otherwise secured in end to end relation with the opposite ends of the adjacent wall segments to complete the subassembly 20*b*. After the wall segments of the second subassembly 20*b* have been connected end to end, the inwardly extending flange 34*c* on the wall segments of the upper or first subassembly 20*a* are crimped upwardly and inwardly against the flange sections 32*b* of the lower assembly 20*b*. This crimping action may be intermittent at spaced intervals or may be continuous. A power driven rolling tool 32 (FIG. 5) having a specially shaped roller assembly 40 formed with a first generally cylindrical rolling die 42 of smaller diameter and spaced apart from a larger diameter rolling die 44 may be used. The tool 38 is power driven to rotate the rolling dies and these dies are pushed upwardly as shown by the arrow "A" in FIG. 5, causing the flange section 34*c* to be deflected or folded as indicated by the arrow "B" against the inside surface of the flange 32*b*. When the rolling or crimping action has been completed, the flanges are tightly interlocked as shown in FIG. 2. With continuous rolling, a positive seal is provided at the junction or joint between the respective upper and lower subassemblies 20*a* and 20*b* around the entire circumference. This process is repeated for each additional subassembly 20*c*, 20*d*, 20*e*, etc., until the desired vessel height is achieved. When this occurs, the jack assemblies are used to lower the subassemblies until the lower flange structure 34 of the vessel shell 16 rests on the concrete or other base footing 14 and is secured thereto to complete the erection of the storage vessel 10.

The electrically powered tool 38 is moved around the circumference of the vessel at each joint to crimp and fold or deflect the inside sloping flanges 34*c* of the lower flange structure 34 tightly against the depending flanges 32*b* of the upper flange structures on the lower subassemblies. The rolling tool is applied externally of the vessel around the outer surface of the shell and from the foregoing it will be seen that the storage vessel 10 is thus adapted to be rapidly and economically constructed to provide a weather tight enclosure. The novel wall segments 22 provide for ease in assembly and erection of the storage vessels and the novel design results in a maximum amount of storage capacity being provided for a minimum cost.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A method for making an upstanding cylindrical storage vessel from a plurality of wall segments having a rectangular shaped, curved, vertically disposed side wall with flange structures along upper and lower edges comprising the steps of:

forming a first cylindrical subassembly of said wall segments by interconnecting a plurality of first wall segments in end to end relation to form a complete circular wall;

forming a second cylindrical subassembly of said wall segments by assembling a plurality of second wall segments onto said first subassembly with adjacent flange structures of said wall segments interconnected in interlocking relation;

supporting wall segments of said second cylindrical subassembly from said first cylindrical subassembly by hanging engagement of the upper flange structure of said second wall segments on the lower flange structure of said first wall segments, and interconnecting said second wall segments in end to end relation to complete said second subassembly interconnected with said first subassembly; and crimping together the adjacent lower and upper flanges of said first and second wall segments of said respective subassemblies by deflecting a horizontal flange segment on said first subassembly upwardly toward a vertical position against an inside surface of a vertical flange segment on said second subassembly.

2. The method of claim 1 wherein said crimping step is accomplished by applying roll means to fold over flanges of one subassembly of end to end interconnected wall segments against the flange of another subassembly externally of said vessel.

3. The method of claim 1 wherein said first subassembly is initially formed at ground level and is subsequently elevated to a height sufficient to clear said second wall segments of said second subassembly positioned therebelow, said second wall segments interconnected with said first subassembly after said elevation with upper edge flange structures on said second wall segments interlocked with lower edge flange segments of said first subassembly.

4. The method of claim 3 wherein said second wall segments are flange interlocked with said first subassembly and supported thereby while said second wall segments are interconnected together in end to end relation to form said second subassembly.

* * * * *